US009897946B2

(12) United States Patent
Imai et al.

(10) Patent No.: US 9,897,946 B2
(45) Date of Patent: Feb. 20, 2018

(54) ROLLER MEMBER INCLUDING A FIRST AND SECOND HIGH RESISTANCE MEMBER AND IMAGE FORMING APPARATUS INCLUDING THE ROLLER MEMBER

(71) Applicants: Masakazu Imai, Kanagawa (JP); Masaharu Furuya, Kanagawa (JP); Tsutomu Kato, Kanagawa (JP); Katsuhito Haruno, Kanagawa (JP); Osamu Ichihashi, Kanagawa (JP); Tatsuya Ohsugi, Kanagawa (JP)

(72) Inventors: Masakazu Imai, Kanagawa (JP); Masaharu Furuya, Kanagawa (JP); Tsutomu Kato, Kanagawa (JP); Katsuhito Haruno, Kanagawa (JP); Osamu Ichihashi, Kanagawa (JP); Tatsuya Ohsugi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/374,167

(22) Filed: Dec. 9, 2016

(65) Prior Publication Data

US 2017/0168430 A1 Jun. 15, 2017

(30) Foreign Application Priority Data

Dec. 15, 2015 (JP) ..... 2015-244287

(51) Int. Cl.
*G03G 15/01* (2006.01)
*G03G 15/16* (2006.01)

(52) U.S. Cl.
CPC ..... *G03G 15/162* (2013.01); *G03G 15/1685* (2013.01)

(58) Field of Classification Search
CPC ..... G03G 15/1605; G03G 15/1685
(Continued)

(56) References Cited

U.S. PATENT DOCUMENTS 8,968,168 B2 * 3/2015 Takeuchi et al. .. G03G 15/0233 399/176
2006/0104677 A1 5/2006 Saito et al.
(Continued)

FOREIGN PATENT DOCUMENTS

| | | |
|---|---|---|
| JP | 2002-311726 | 10/2002 |
| JP | 2005-077539 | 3/2005 |
| JP | 2015-059967 | 3/2015 |

*Primary Examiner* — William J Royer
(74) *Attorney, Agent, or Firm* — Oblon, McClelland, Maier & Neustadt, L.L.P.

(57) ABSTRACT

A roller member includes a cored bar, an elastic layer, a first high resistance member, and a second high resistance member. The elastic layer is disposed on an outer circumferential face of the cored bar. The cored bar has a projecting portion projecting beyond a range in which the elastic layer is disposed, toward an axial end of the cored bar. The first high resistance member is made of a high-resistance material having a higher electrical resistance than an electrical resistance of the cored bar. The first high resistance member is fitted to the projecting portion. The second high resistance member is made of a high-resistance material having a higher electrical resistance than an electrical resistance of the cored bar. The second high resistance member fills a space between the first high resistance member and the elastic layer.

10 Claims, 6 Drawing Sheets

(58) Field of Classification Search
USPC ..... 399/176, 302, 313
See application file for complete search history.

(56) References Cited

U.S. PATENT DOCUMENTS

| | | | |
|---|---|---|---|
| 2006/0210324 | A1 | 9/2006 | Kuma et al. |
| 2007/0127947 | A1 | 6/2007 | Kuma et al. |
| 2008/0187343 | A1 | 8/2008 | Yamaguchi et al. |
| 2010/0067952 | A1 | 3/2010 | Fujita et al. |
| 2010/0142985 | A1 | 6/2010 | Minbe et al. |
| 2010/0221029 | A1 | 9/2010 | Minbu et al. |
| 2011/0158690 | A1 | 6/2011 | Mimbu et al. |
| 2013/0223901 | A1 | 8/2013 | Minbe et al. |
| 2014/0334847 | A1 | 11/2014 | Takahashi et al. |
| 2015/0090564 | A1 | 4/2015 | Iwaya et al. |
| 2015/0125189 | A1 | 5/2015 | Hozumi et al. |
| 2015/0227089 | A1 | 8/2015 | Hozumi et al. |
| 2016/0062279 | A1 | 3/2016 | Hozumi et al. |

* cited by examiner

ROLLER MEMBER INCLUDING A FIRST AND SECOND HIGH RESISTANCE MEMBER AND IMAGE FORMING APPARATUS INCLUDING THE ROLLER MEMBER

CROSS-REFERENCE TO RELATED APPLICATION

This patent application is based on and claims priority pursuant to 35 U.S.C. § 119(a) to Japanese Patent Application No. 2015-244287, filed on Dec. 15, 2015, in the Japan Patent Office, the entire disclosure of which is hereby incorporated by reference herein.

BACKGROUND

Technical Field

Aspects of the present disclosure relate to a roller member having a cored bar and an elastic layer on an outer circumferential face of the cored bar, and an electrophotographic image forming apparatus, such as a copier, a printer, a facsimile machine, or a multifunction peripheral having at least two of the foregoing capabilities that includes the roller member.

Related Art

There has been conventionally known an image forming apparatus, such as a copier or a printer that uses a roller member in which an elastic layer is formed on the outer circumferential face of a cored bar, as a roller member such as a secondary transfer roller and a secondary transfer opposite roller, and performs a secondary transfer step by applying a secondary transfer bias high voltage, to the roller member. Specifically, in a color image forming apparatus, an intermediate transfer belt travels in a predetermined direction, and respective toner images are primarily transferred onto the intermediate transfer belt and superimposed one on another at the positions of a plurality of primary transfer nips. Then, the toner image is secondarily transferred onto a recording medium conveyed to the position of a secondary transfer nip of the intermediate transfer belt and a secondary transfer roller. This secondary transfer nip is formed by the secondary transfer roller and a secondary transfer opposite roller contacting each other via the intermediate transfer belt. In addition, such a secondary transfer step is performed by applying a predetermined secondary transfer bias to at least either one of the secondary transfer roller and the secondary transfer opposite roller.

In some cases, a support including a collar or a spacer is rotatably installed on a support shaft of the roller member to which the secondary transfer bias is to be applied, so as not to generate leakage by applying the secondary transfer bias high voltage, to the roller member such as the secondary transfer roller and the secondary transfer opposite roller.

SUMMARY

In one aspect of the present disclosure, there is provided a roller member that includes a cored bar, an elastic layer, a first high resistance member, and a second high resistance member. The elastic layer is disposed on an outer circumferential face of the cored bar. The cored bar has a projecting portion projecting beyond a range in which the elastic layer is disposed, toward an axial end of the cored bar. The first high resistance member is made of a high-resistance material having a higher electrical resistance than an electrical resistance of the cored bar. The first high resistance member is fitted to the projecting portion. The second high resistance member is made of a high-resistance material having a higher electrical resistance than an electrical resistance of the cored bar. The second high resistance member fills a space between the first high resistance member and the elastic layer.

In another aspect of the present disclosure, there is provided an image forming apparatus that includes an image bearer, a transfer roller, the roller member, and a power source. The image bearer bears a toner image. The transfer roller contacts the image bearer directly or via a belt member to form a transfer nip. The roller member is disposed opposing the transfer roller at the transfer nip. The power source outputs a transfer bias to transfer the toner image from the image bearer onto a recording medium at the transfer nip. The power source directly or indirectly applies the transfer bias to the cored bar.

In yet another aspect of the present disclosure, there is provided an image forming apparatus that includes an image bearer, the roller member, and a power source. The image bearer bears a toner image. The roller member contacts the image bearer directly or via a belt member to form a transfer nip. The power source outputs a transfer bias to transfer the toner image from the image bearer onto a recording medium at the transfer nip. The power source directly or indirectly applies the transfer bias to the cored bar.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
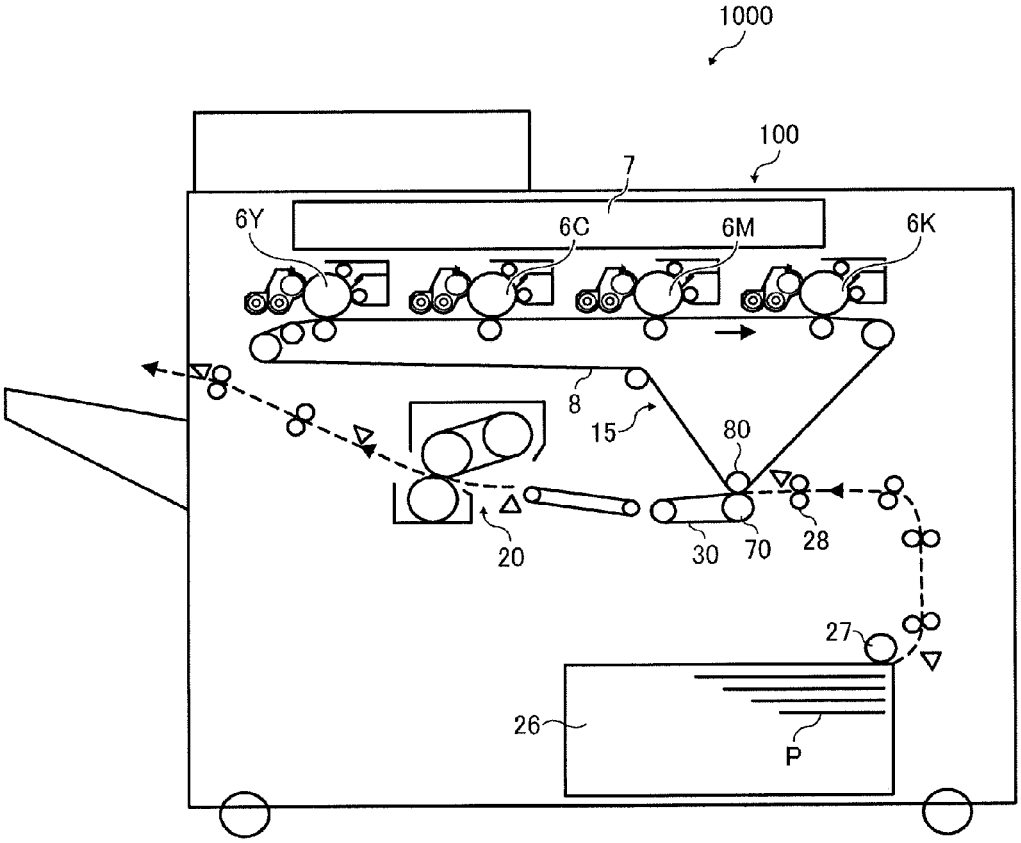
FIG. 1 is a general arrangement diagram illustrating an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Embodiment

An embodiment of the present disclosure will be described in detail below referring to the drawings. In addition, in the drawings, the same or corresponding parts are assigned the same signs, and the redundant descriptions thereof will be appropriately simplified or omitted.

Figure 2:
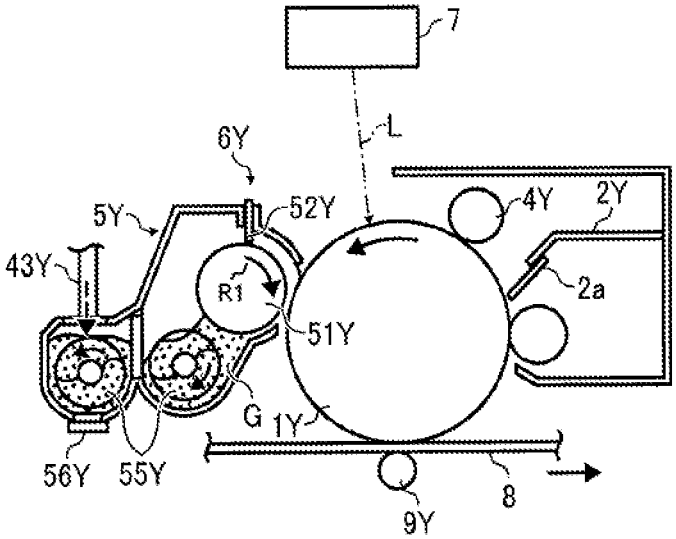
FIG. 2 is a configuration diagram illustrating a part of an image forming unit according to an embodiment of the present disclosure, in an enlarged manner.

First, referring to FIGS. 1 and 2, the general arrangement and the operation of an image forming apparatus 1000 will be described. FIG. 1 is a configuration diagram illustrating a printer serving as an image forming apparatus 1000. FIG. 2 is an enlarged view illustrating an image forming unit 6Y of the image forming apparatus 1000. As illustrated in FIG. 1, an intermediate transfer belt device 15 is installed at the center of an apparatus body 100 of the image forming apparatus 1000. In addition, image forming units 6Y, 6C, 6M, and 6K corresponding to the respective colors (yellow, magenta, cyan, and black) are disposed side by side to oppose an intermediate transfer belt 8 (image bearer) of the intermediate transfer belt device 15.

Referring to FIG. 2, the image forming unit 6Y corresponding to yellow includes a photoconductor drum 1Y serving as a photoconductor, a charging unit 4Y disposed at the circumference of the photoconductor drum 1Y, a developing unit 5Y, a cleaning unit 2Y, electric discharging unit, and the like. In addition, an image forming process (a charging step, an exposure step, a developing step, a transfer step, and cleaning step) is performed on the photoconductor drum 1Y, so that a yellow image is formed on the photoconductor drum 1Y.

In addition, the other three image forming units 6C, 6M, and 6K also have substantially the same configurations as the configuration of the image forming unit 6Y corresponding to yellow, except that the colors of toners to be used are different. Images corresponding to the respective toner colors are formed on the image forming units 6C, 6M, and 6K. Hereinafter, the descriptions of the other 3 image forming units 6C, 6M, and 6K will be appropriately omitted, and only the description of the image forming unit 6Y corresponding to yellow will be given.

Referring to FIG. 2, the photoconductor drum 1Y is driven by a drive motor to rotate in a counterclockwise direction. Then, the surface of the photoconductor drum 1Y is uniformly charged at the position of the charging unit 4Y (, which corresponds to the charging step). After that, the surface of the photoconductor drum 1Y reaches an irradiation position of laser light L emitted from an exposure unit 7, and at the position, an electrostatic latent image corresponding to yellow is formed through an exposure scanning performed (, which corresponds to the exposure step).

Then, the surface of the photoconductor drum 1Y reaches a position opposing the developing unit 5Y, and the electrostatic latent image is developed at the position, so that a yellow toner image is formed (, which corresponds to the developing step). After that, the surface of the photoconductor drum 1Y reaches a position opposing the intermediate transfer belt 8 (belt member) serving as an image bearer, and a primary transfer roller 9Y, and at the position, the toner image on the photoconductor drum 1Y is transferred onto the intermediate transfer belt 8 (, which corresponds to the primary transfer step). At this time, a small amount of untransferred toner remains on the photoconductor drum 1Y.

After that, the surface of the photoconductor drum 1Y reaches a position opposing the cleaning unit 2Y, and at the position, the untransferred toner remaining on the photoconductor drum 1Y is collected by a cleaning blade 2*a* into the cleaning unit 2Y (, which corresponds to the cleaning step). Lastly, the surface of the photoconductor drum 1Y reaches a position opposing the electric discharging unit, and residual potential on the photoconductor drum 1Y is removed at the position. In this manner, a series of image forming processes performed on the photoconductor drum 1Y ends.

In addition, the above-described image forming processes are performed also in the other image forming units 6C, 6M, and 6K similarly to the yellow image forming unit 6Y. In other words, the laser light L that is based on image information is emitted from the exposure unit 7 disposed above the image forming units 6C, 6M, and 6K toward photoconductor drums 1C, 1M, and 1K of the respective image forming units 6C, 6M, and 6K. Specifically, the exposure unit 7 emits the laser light L from a light source onto the photoconductor drums 1Y, 1C, 1M, and 1K via a plurality of optical elements while scanning the laser light L using a polygon mirror driven to rotate. After that, the toner images of the respective colors that have been formed on the respective photoconductor drums 1Y, 1C, 1M, and 1K through the developing step are primarily transferred onto the intermediate transfer belt 8 and superimposed one on another. In this manner, a color image is formed on the intermediate transfer belt 8.

Figure 3:
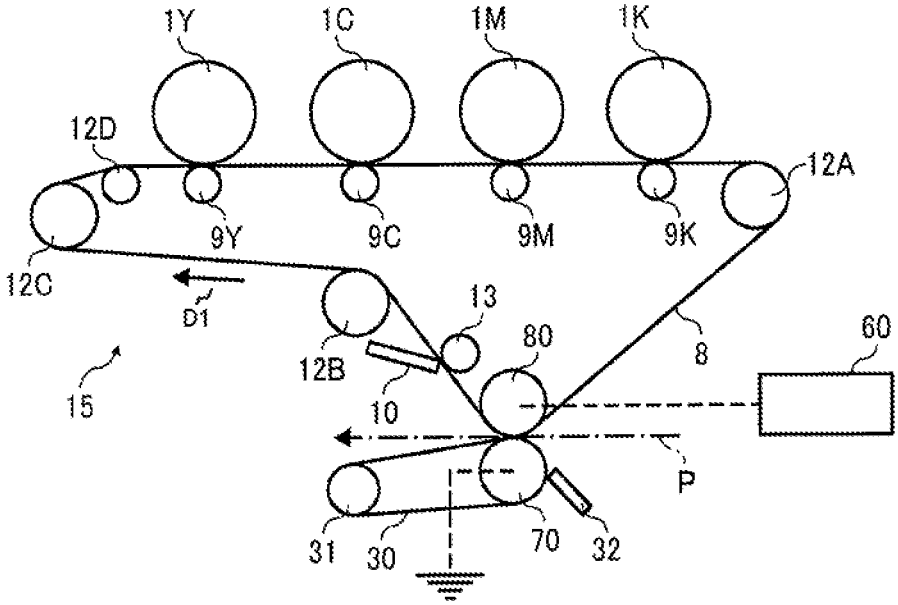
FIG. 3 is a schematic view illustrating an intermediate transfer belt and a vicinity thereof according to an embodiment of the present disclosure.

Here, referring to FIG. 3, the intermediate transfer belt device 15 includes the intermediate transfer belt 8 serving as an image bearer, four primary transfer rollers 9Y, 9C, 9M, and 9K, a drive roller 12A, a secondary transfer opposite roller 80 (transfer opposite member) serving as a roller member, a tension roller 12B, driven rollers 12C and 12D, a cleaning opposite roller 13, an intermediate transfer cleaner 10, a secondary transfer roller 70 (transfer member), a secondary transfer conveyance belt 30 (belt member), and the like. The intermediate transfer belt 8 is stretched around and supported by the plurality of roller members (i.e., the secondary transfer opposite roller 80, the drive roller 12A, the tension roller 12B, the driven rollers 12C and 12D, and the cleaning opposite roller 13), and is endlessly moved by the rotational driving of one roller member (the drive roller 12A) in a direction indicated by arrow D1 in FIG. 3.

The four primary transfer rollers 9Y, 9C, 9M, and 9K and the photoconductor drums 1Y, 1C, 1M, and 1K, respectively, nip the intermediate transfer belt 8 to form primary transfer nips. Then, a transfer voltage (primary transfer bias) having a reverse polarity of the polarity of toner is applied to the primary transfer rollers 9Y, 9C, 9M, and 9K. Then, the intermediate transfer belt 8 travels in the direction indicated by arrow D1, and sequentially passes through the primary transfer nips of the primary transfer rollers 9Y, 9C, 9M, and 9K. In this manner, the toner images of the respective colors on the photoconductor drums 1Y, 1C, 1M, and 1K are primarily transferred onto the intermediate transfer belt 8 and superimposed one on another.

After that, the intermediate transfer belt 8 on which the toner images of the respective colors are primarily transferred and superimposed one on another reaches a position opposing the secondary transfer roller 70 (secondary transfer conveyance belt 30). At the position, the secondary transfer opposite roller 80 (roller member) nip the intermediate transfer belt 8 and the secondary transfer conveyance belt 30 between the secondary transfer opposite roller 80 and the secondary transfer roller 70 to form a transfer nip (secondary transfer nip). Then, the toner image of four colors that is formed on the intermediate transfer belt 8 is secondarily transferred onto a recording medium P such as a sheet of paper that has been conveyed to the position of the secondary transfer nip (transfer nip). At this time, untransferred toner that has not been transferred onto the recording medium P remains on the intermediate transfer belt 8.

After that, the intermediate transfer belt 8 reaches the position of the intermediate transfer cleaner 10. Then, the untransferred toner on the intermediate transfer belt 8 is removed at the position. In this manner, a series of transfer processes performed on the intermediate transfer belt 8 ends.

Here, referring to FIG. 1, the recording medium P conveyed to the position of the secondary transfer nip has been conveyed from a sheet feeding unit 26 disposed on the lower side of the apparatus body 100 of the image forming apparatus 1000, via a sheet feeding roller 27, paired registration rollers 28, and the like. Specifically, a plurality of the recording media P such as transfer sheets are superimposed on one another and stored in the sheet feeding unit 26. In addition, if the sheet feeding roller 27 is driven to rotate in the counterclockwise direction in FIG. 1, the uppermost recording medium P is fed toward a portion between the rollers of the paired registration rollers 28.

The recording medium P conveyed to the paired registration rollers 28 (paired timing rollers) once stops at the position of a roller nip of the paired registration rollers 28 that have stopped the rotational driving. Then, the paired registration rollers 28 are driven to rotate at a timing appropriate for the color image on the intermediate transfer belt 8, and the recording medium P is conveyed toward the secondary transfer nip. In this manner, a desired color image is transferred onto the recording medium P.

Then, the recording medium P on which the color image has been transferred at the position of the secondary transfer nip is conveyed by the secondary transfer conveyance belt 30 in a direction indicated by a dashed-dotted line arrow in FIG. 3, and further conveyed to the position of a fixing unit 20 by a pre-fixing conveyance belt. Then, at the position, by the heat and the pressure of a fixing belt and a pressure roller, the color image transferred on the surface is fixed onto the recording medium P. After that, the recording medium P is ejected by paired sheet ejection rollers to the outside of the image forming apparatus 1000. The recording media P that have been ejected by the paired sheet ejection rollers to the outside of the apparatus are sequentially stacked on a stack portion as output images. In this manner, a series of image formation processes in the image forming apparatus 1000 is completed.

Next, referring to FIG. 2, the configuration and the operation of the developing unit 5Y (developing device) in the image forming unit 6Y will be described in more detail. The developing unit 5Y includes a developing roller 51Y opposing the photoconductor drum 1Y, a doctor blade 52Y opposing the developing roller 51Y, two conveying screws 55Y disposed in a developer container, a toner replenishment passage 43Y communicated with the developer container via an opening, a density detection sensor 56Y for detecting the density of toner in developer, and the like. The developing roller 51Y includes a magnet fixedly installed thereinside, a sleeve rotating around the magnet, and the like. Two-component developer G including carrier and toner is contained in the developer container.

The developing unit 5Y having the above-described configuration operates in the following manner. The sleeve of the developing roller 51Y is rotating in a direction indicated by arrow R1 in FIG. 2. In addition, developer G borne on the developing roller 51Y by a magnetic field formed by the magnet moves on the developing roller 51Y in accordance with the rotation of the sleeve. Here, the developer G in the developing unit 5Y is adjusted so that the rate of toner in the developer (toner density) falls within a predetermined range. After that, toner replenished into the developer container circulates in two isolated developer containers (corresponds to the movement in a direction vertical to a sheet face on which FIG. 2 is printed) while being mixed with the developer G and stirred by the two conveying screws 55Y. Then, the toner in the developer G is attracted to the carrier by frictional charging with the carrier, and is borne on the developing roller 51Y together with the carrier by magnetic force formed on the developing roller 51Y.

The developer G borne on the developing roller 51Y is conveyed in the direction indicated by arrow R1 in FIG. 2, to reach the position of the doctor blade 52Y. Then, after the developer amount of the developer G on the developing roller 51Y is adjusted to an appropriate amount at the position, the developer G is conveyed to a position (corresponds to a developing area) opposing the photoconductor drum 1Y. Then, by an electric field formed in the developing area, toner is attracted to the latent image formed on the photoconductor drum 1Y. After that, developer G remaining on the developing roller 51Y reaches the upper side of the developer container in accordance with the rotation of the sleeve, and is detached from the developing roller 51Y at the position.

Next, the intermediate transfer belt device 15 in the present embodiment will be described in detail using FIGS. 3 and 4. Referring to FIG. 3, the intermediate transfer belt device 15 includes the intermediate transfer belt 8 serving as an image bearer, the four primary transfer rollers 9Y, 9C, 9M, and 9K, the drive roller 12A, the secondary transfer opposite roller 80 (transfer opposite member) serving as a roller member, the tension roller 12B, the driven rollers 12C and 12D, the cleaning opposite roller 13, the intermediate transfer cleaner 10, the secondary transfer roller 70 (transfer member), the secondary transfer conveyance belt 30 (belt member), and the like.

The intermediate transfer belt 8 is disposed to oppose the four photoconductor drums 1Y, 1C, 1M, and 1K bearing the toner images of the respective colors. The intermediate transfer belt 8 is stretched around and supported by mainly six roller members (corresponding to the drive roller 12A, the secondary transfer opposite roller 80, the tension roller 12B, the driven rollers 12C and 12D, and the cleaning opposite roller 13).

In the present embodiment, the intermediate transfer belt 8 includes polyvinylidene fluoride (PVDF), ethylene-tetrafluoroethylene copolymer (ETFE), polyimide (PI), polycarbonate (PC), and the like, in a single layer or a plurality of layers, and is obtained by dispersing conductive material such as carbon black. The intermediate transfer belt 8 is adjusted so that a volume resistivity falls within a range of $10^6$ to $10^{13}$ Ωcm, and a surface resistivity of a belt rear surface side falls within a range of $10^7$ to $10^{13}$Ω/□. In addition, the intermediate transfer belt 8 is set so that the thickness falls within a range of 20 to 200 μm. In the present embodiment, the thickness of the intermediate transfer belt 8 is set to about 60 μm, and the volume resistivity thereof is set to about $10^9$ Ωcm. In addition, the surface of the intermediate transfer belt 8 can be coated with a release layer as necessary. At this time, fluorine-containing resin such as ethylene-tetrafluoroethylene copolymer (ETFE), polytetrafluoroethylene (PTFE), polyvinylidene fluoride (PVDF), perfluoroalkoxy fluorine-containing resin (PEA), tetrafluoroethylene-hexafluoropropylene copolymer (FEP), and vinyl fluoride (PVF) can be used as material used for coating. Nevertheless, the material is not limited to these. In addition, examples of the manufacturing method of the intermediate transfer belt 8 include a cast molding method, a centrifugal molding method, and the like. The step of polishing the surface thereof is performed as necessary. In addition, the above-described volume resistivity of the intermediate transfer belt 8 was measured by using "Hiresta UPMCPHT45" (manufactured by Mitsubishi Chemical Corporation) under the condition of applied voltage being 100 V.

The primary transfer rollers 9Y, 9C, 9M, and 9K oppose the respective photoconductor drums 1Y, 1C, 1M, and 1K via the intermediate transfer belt 8. Specifically, the transfer roller 9Y for yellow opposes the photoconductor drum 1Y for yellow via the intermediate transfer belt 8, the transfer roller 9M for magenta opposes the photoconductor drum 1M for magenta via the intermediate transfer belt 8, the transfer roller 9C for cyan opposes the photoconductor drum 1C for cyan via the intermediate transfer belt 8, and the transfer roller 9K for black (for black color) opposes the photoconductor drum 1K for black (for black color) via the intermediate transfer belt 8. Each of the primary transfer rollers 9Y, 9C, 9M, and 9K is an elastic roller in which a conductive sponge layer having an outer diameter of about 16 mm is formed on a cored bar having a diameter of 10 mm, and is adjusted so that the volume resistance falls within a range of $10^6$ to $10^{12}$Ω (preferably, $10^7$ to $10^9$Ω).

The drive roller 12A is driven by the drive motor to rotate. As a result, the intermediate transfer belt 8 travels in a predetermined travel direction (clockwise direction in FIG. 3). The tension roller 12B contacts the outer circumferential face of the intermediate transfer belt 8. The intermediate transfer cleaner 10 (cleaning blade) is installed between the secondary transfer opposite roller 80 and the tension roller 12B to oppose the cleaning opposite roller 13 via the intermediate transfer belt 8. The driven rollers 12C and 12D contact the inner circumferential face of the intermediate transfer belt 8.

Figure 4:
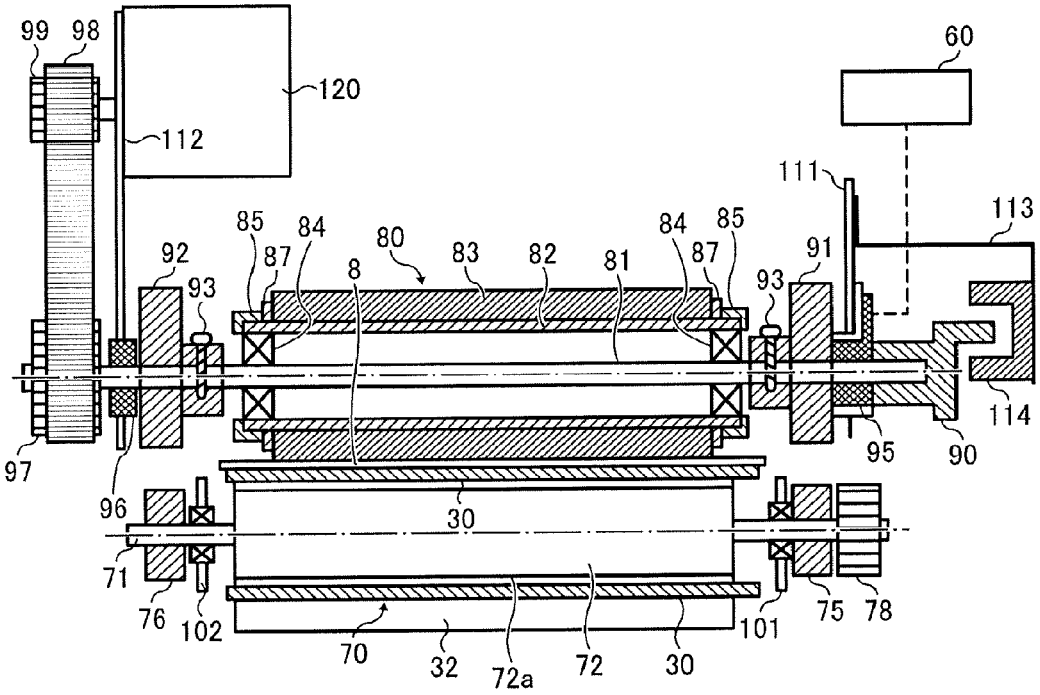
FIG. 4 is a cross-sectional view illustrating a state in which a secondary transfer opposite roller and a secondary transfer roller contact each other via the intermediate transfer belt and a secondary transfer conveyance belt according to an embodiment of the present disclosure, in an axial direction.

Referring to FIGS. 3 and 4, the secondary transfer opposite roller 80 (transfer opposite roller) serving as a roller member contacts the secondary transfer roller 70 via the intermediate transfer belt 8 (image bearer) and the secondary transfer conveyance belt 30 (belt member). The secondary transfer opposite roller 80 (transfer opposite roller) is a roller in which an elastic layer 83 (has a layer thickness of about 5 mm) made of nitrile rubber (NBR) foam rubber having a volume resistance of about $10^7$ to $10^8$ Ωcm, and a hardness (Asker-C hardness) of about 48 to 58 degrees is formed on the outer circumferential face of a cylindrical cored bar 82 made of stainless steel or the like. In addition, a resistance value (roller resistance value) of the secondary transfer opposite roller 80 is set to about 7.75±0.25 Log Ω. This resistance value (roller resistance value) corresponds to an average value of values obtained by measuring current values in the third rotation since the rotation start, at 32 points in the circumferential direction of a jig drum by pressing the secondary transfer opposite roller 80 against the jig drum with a load of 10 N on one side, and applying voltage of DC1±0.1 kV to the cored bar 82, in the hygrothermal environment of 25±5° C. and 60±10% RH. In addition, non-conductive members 85 (first high resistance members) and elastic members 87 (second high resistance members) that function as a leakage stopper are lightly pressed into both axial ends of the cored bar 82 of the secondary transfer opposite roller 80 in the present embodiment, for preventing the leakage incidental to the application of high voltage. This will be described in detail later.

In the present embodiment, the cored bar 82 of the secondary transfer opposite roller 80 is formed in a cylindrical shape, and the cored bar 82 is held on a shaft 81 (support shaft) via bearings 84 (are ball bearings having conductivity from an inner ring side to an outer inner ring). Specifically, the bearings 84 are pressed into the both end faces in the axial direction (width direction) of the cored bar 82, and the shaft 81 made of conductive metal material is inserted into these bearings 84. Thus, in the secondary transfer opposite roller 80, the shaft 81 is formed to be rotatable independently of the cored bar 82 (and the elastic layer 83) rotating together with the intermediate transfer belt 8 by the friction resistance with the intermediate transfer belt 8. The both ends in the axial direction (corresponds to a direction vertical to a sheet face on which FIG. 3 is printed, and to a horizontal direction in FIG. 4) of the shaft 81 are rotatably held on side plates 111 and 112 of a housing of the intermediate transfer belt device 15 that holds the secondary transfer opposite roller 80, via bearings 95 and 96 (slide bearings). In addition, on one end in the axial direction of the shaft 81, a pulley 97 is installed to be rotatable together with the shaft 81. In addition, a timing belt 98 is stretched around the pulley 97 and a pulley 99 installed on a motor shaft of a stepping motor 120 fixedly installed on the side plate 112 on one end side in the axial direction. With such a configuration, the shaft 81 is rotated with an arbitrary rotation angle or the rotation is stopped, according to the driving or driving stop of the stepping motor 120, independently of the cored bar 82 (and the elastic layer 83).

In addition, cams 91 and 92 are secured and installed on both axial ends of the shaft 81 by fastening using screws 93. In addition, when the rotation angle of the shaft 81 is adjusted through the drive control of the stepping motor 120 so that the cams 91 and 92 do not contact below-described rollers 75 and 76 of the secondary transfer roller 70, the secondary transfer opposite roller 80 and the secondary transfer roller 70 enter a state in which the secondary transfer opposite roller 80 and the secondary transfer roller 70 contact each other via the intermediate transfer belt 8 and the secondary transfer conveyance belt 30 (corresponds to the state in FIGS. 3 and 4), and a normal image formation process (secondary transfer step) is performed. In contrast to this, when the rotation angle of the shaft 81 is adjusted through the drive control of the stepping motor 120 so that the cams 91 and 92 contact the rollers 75 and 76 of the secondary transfer roller 70, the cams 91 and 92 push the secondary transfer roller 70 downward against the biasing force of a biasing member, and the secondary transfer roller 70 is separated from the secondary transfer opposite roller 80 (the intermediate transfer belt 8) together with the secondary transfer conveyance belt 30. Such a separating operation is performed when the secondary transfer step is not performed in the secondary transfer nip. This prevents such a failure that a pressed state continues for a long time, and permanent distortion is generated in the secondary transfer roller 70, the secondary transfer opposite roller 80, the intermediate transfer belt 8, or the secondary transfer conveyance belt 30. In addition, the control of the rotation angle of the shaft 81 is performed by controlling the stepping motor 120, and optically detecting a detection plate 90 fixedly installed on the other end side in the axial direction of the shaft 81, using a photosensor 114 (secured and installed on the side plate 111 via a bracket 113).

In addition, in the present embodiment, the secondary transfer opposite roller 80 (the cored bar 82) is electrically connected to a power source 60 serving as a bias output device, and a secondary transfer bias being a high voltage of about −10 kV is applied from the power source 60. Specifically, referring to FIG. 4, the secondary transfer bias is applied from the bearing 95 (made of conductive material) connected to the power source 60, to the cored bar 82 via the shaft 81 and the bearing 84 (made of conductive material). The secondary transfer bias output from the power source 60 and applied to the secondary transfer opposite roller 80 is a bias for secondarily transferring the toner image borne on the intermediate transfer belt 8, onto the recording medium P conveyed to the secondary transfer nip, and is a bias (direct current voltage) having the same polarity (corresponds to the negative polarity in the present embodiment) as the polarity of toner. As a result, the toner borne on the toner bearing face (outer circumferential face) of the intermediate transfer belt 8 is electrostatically moved by a secondary transfer electric field from the secondary transfer opposite roller 80 side toward the secondary transfer roller 70 side.

The secondary transfer roller 70 (transfer roller) contacts the toner bearing face (outer circumferential face) of the intermediate transfer belt 8 via the secondary transfer conveyance belt 30, to form the secondary transfer nip to which the recording medium P is conveyed. The secondary transfer roller 70 has an outer diameter of about 25 mm, and is a roller in which an elastic layer 72*a* having a hardness (JIS-A hardness) of about 60 to 70 degrees is formed (coated) on a hollow cored bar 72 made of stainless steel, aluminum, or the like, and having a diameter of about 24 mm. The elastic layer 72*a* of the secondary transfer roller 70 can be formed in a solid shape or a foam sponge shape by dispersing conductive material such as carbon, in rubber material such as polyurethane, ethylene-propylene diene rubber (EPDM), and silicone, or containing ionic conductive material. In the present embodiment, the volume resistivity of the elastic layer 72*a* is set to about $10^{7.5}$ Ωcm or less, for preventing the concentration of transfer current. In addition, a resistance value (roller resistance value) of the secondary transfer roller 70 is set to be $1\times10^{6}$Ω or less. The resistance value (roller resistance value) corresponds to an average value of values obtained by measuring current values in the third rotation since the rotation start, at 32 points in the circumferential direction of the jig drum by pressing the secondary transfer roller 70 against the jig drum with a load of 10 N on one side, and applying voltage of DC1±0.1 kV to the cored bar 72, in the hygrothermal environment of 22±1° C. and 55±5% RH.

Flanges having shaft portions 71 are pressed into both axial ends of the cored bar 72 of the secondary transfer roller 70. In addition, the secondary transfer roller 70 (the shaft portions 71) is rotatably held on side plates 101 and 102 of a housing that holds the secondary transfer roller 70, via bearings. The housing that holds the secondary transfer roller 70 is formed to be movable in a vertical direction in FIGS. 3 and 4, together with the secondary transfer roller 70, and is biased by a biasing member in a direction to contact the intermediate transfer belt 8 (the secondary transfer opposite roller 80). In addition, the above-described rollers 75 and 76 that can contact the cams 91 and 92 are installed on the respective shaft portions 71 at both axial ends of the secondary transfer roller 70, to be relatively-rotatable with respect to the shaft portions 71. Furthermore, a gear 78 is installed on the shaft portion 71 on one end side in the axial direction of the secondary transfer roller 70, to be rotatable together with the shaft portion 71. If drive force is transmitted to the gear 78, the secondary transfer roller 70 is driven to rotate in a counterclockwise direction in FIG. 3. In addition, in the present embodiment, in the secondary transfer roller 70, the cored bar 72 is grounded via the shaft portions 71.

Referring to FIG. 3, the secondary transfer conveyance belt 30 serving as a belt member is an endless belt stretched around and supported by two roller members (correspond to the secondary transfer roller 70 and a driven roller 31). The secondary transfer conveyance belt 30 travels in a counterclockwise direction in FIG. 3 so as to go along the conveyance direction of the recording medium P, by the secondary transfer roller 70 being driven by a drive motor to rotate in the counterclockwise direction in FIG. 3. A known belt can be used as the secondary transfer conveyance belt 30. For example, a belt that includes polyvinylidene fluoride (PVDF) or the like, in a single layer or a plurality of layers, and is obtained by dispersing conductive material such as carbon black can be used. As for the secondary transfer conveyance belt 30, a volume resistivity is set to about $10^{10}$ to $10^{12}$ Ωcm, a surface resistivity of a belt rear surface side is set to about $10^{12}$ to $10^{14}$Ω/□, and a thickness is set to about 100 μm.

In addition, referring to FIGS. 3 and 4, a belt cleaning blade 32 is installed at an upstream side position in a travelling direction of the secondary transfer conveyance belt 30 with respect to the secondary transfer nip. The belt cleaning blade 32 contacts the secondary transfer roller 70 via the secondary transfer conveyance belt 30 at a predetermined angle and with predetermined pressure. The belt cleaning blade 32 is made of rubber material such as urethane rubber, and is provided for mechanically removing an adherent such as toner and paper powder that adheres to the secondary transfer conveyance belt 30. The adherent scraped off by the belt cleaning blade 32 is to be collected into a case. In addition, the releasability of the belt surface with respect to toner can be increased by forming a release layer such as semiconductive fluorine-containing resin and urethane resin, on the surface of the secondary transfer conveyance belt 30.

Here, as illustrated in FIG. 4, in the present embodiment, the range in the axial direction (corresponds to a horizontal direction in FIG. 4) of the elastic layer 83 in the secondary transfer opposite roller 80 is formed to be included in the range in the axial direction of the elastic layer 72*a* (is a roller portion) in the secondary transfer roller 70. In addition, the range in the axial direction of the elastic layer 72*a* in the secondary transfer roller 70 is formed to be included in the range in the axial direction of the intermediate transfer belt 8 and the secondary transfer conveyance belt 30. Furthermore, the range in the axial direction of the elastic layer 83 in the secondary transfer opposite roller 80 is formed to be included in the range in the axial direction of the belt cleaning blade 32 (is set to be substantially equal to the range in the axial direction of the elastic layer 72*a*). The range in the axial direction of the elastic layer 83 in the secondary transfer opposite roller 80 is formed to be slightly larger than a sheet-passage area of the recording medium P having the sheet-passable maximum size, and to include the sheet-passage area. With this configuration, in a state in which there is no extra space in the axial direction because of the installation of the cams 91 and 92, the timing belt 98, and the like, the size in the axial direction of the secondary transfer opposite roller 80 can be minimized. In addition, in the secondary transfer conveyance belt 30, in addition to an adherent adhering to the sheet-passage area, an adherent adhering to the outside of the sheet-passage area can also be reliably cleaned by the belt cleaning blade 32.

Nevertheless, when the range in the axial direction of the elastic layer 83 in the secondary transfer opposite roller 80 is formed to be included in the range in the axial direction of the elastic layer 72*a* in the secondary transfer roller 70 in this manner, if the outer diameter of the elastic layer 83 in the secondary transfer opposite roller 80 locally increases, the secondary transfer nip becomes ununiform in the axial direction, so that a transfer failure such as transfer unevenness is easily generated in a toner image transferred from the intermediate transfer belt 8 onto the recording medium P. In contrast to this, in the present embodiment, as described in detail later, on a projecting portion 82*a* of the cored bar 82 of the secondary transfer opposite roller 80, the non-conductive member 85 (first high resistance member) is installed to contact the elastic layer 83 via the flexible elastic member 87 (second high resistance member). Such a configuration prevents the generation of leakage starting from the projecting portion 82*a*, while preventing such a failure that the outer diameter of an axial end of the elastic layer 83 locally increases.

The secondary transfer opposite roller 80 serving as a roller member, which is characteristic in the present embodiment, will be described in detail below using FIGS. 4 to 6, and the like. As described above using FIG. 4 and the like, the secondary transfer opposite roller 80 serving as a roller member in the present embodiment is a roller in which the elastic layer 83 is formed on the outer circumferential face of the cored bar 82, and the secondary transfer bias being a high voltage of about −10 kV is applied to the cored bar 82. The cored bar 82 is made of conductive metal material such as stainless steel and carbon steel.

Figure 5:
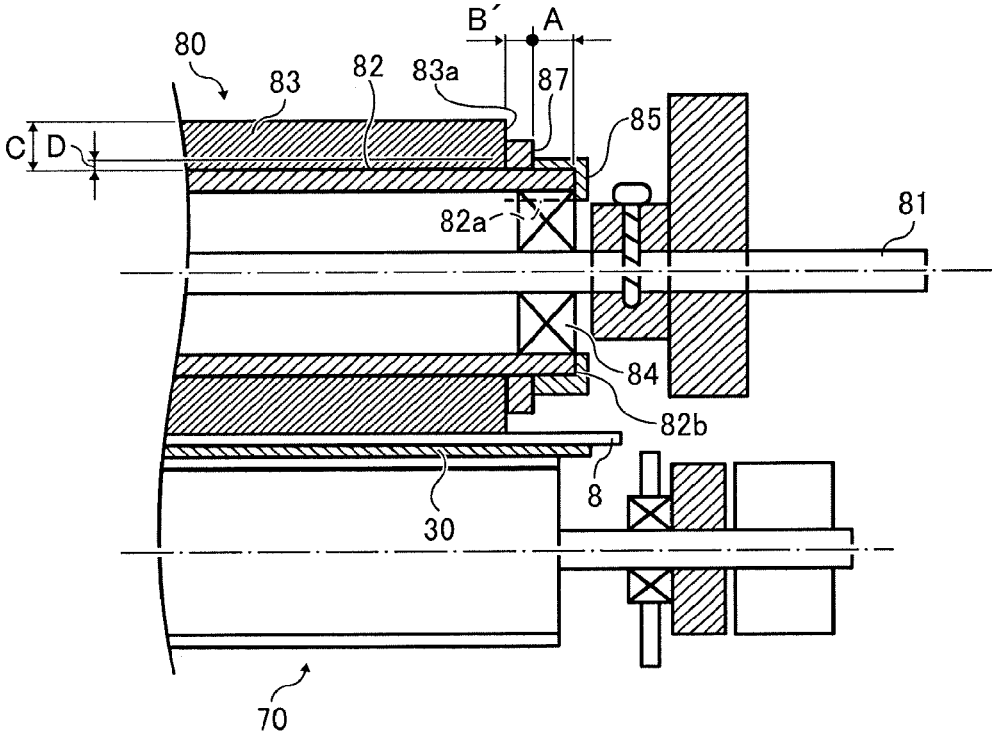
FIG. 5 is a cross-sectional view illustrating an axial end in FIG. 4 according to an embodiment of the present disclosure, in an enlarged manner.

Here, referring to FIG. 5 and the like, the cored bar 82 of the secondary transfer opposite roller 80 (roller member) has the projecting portion 82*a* formed so as to project from a range in which the elastic layer 83 is formed, toward an axial end. Specifically, the cored bar 82 of the secondary transfer opposite roller 80 (roller member) is provided with the projecting portion 82*a* on which the elastic layer 83 is not formed, and which is formed so as to project toward the axial end, on the outside of the range in the axial direction (corresponds to the horizontal direction in FIGS. 4 and 5) in which the elastic layer 83 is formed. In other words, the elastic layer 83 is stacked on the outer circumferential face of the cored bar 82 not throughout the entire regions in the axial direction, but the elastic layer 83 is stacked on a range obtained by excluding a fixed range A (having about 5 mm) at each axial end. The projecting portion 82*a* is formed on the cored bar 82 (the secondary transfer opposite roller 80) in this manner for the processing-related reason for forming the elastic layer 83 having a layer thickness uniform to some extent, on the cored bar 82. Specifically, in the step of stacking the elastic layer 83 on the cored bar 82, first, the elastic layer 83 is pressed onto the cored bar 82. In this state, the outer diameter cannot be uniform because of the deformation of the elastic layer 83. Thus, cutting is subsequently performed in a state in which both axial ends of the cored bar 82 are chucked, thereby uniformizing the outer diameter of the elastic layer 83. In this manner, the projecting portions 82*a* are provided at both axial ends of the cored bar 82 for the chucking in the cutting step.

In addition, as illustrated in FIG. 5, in the secondary transfer opposite roller 80 (roller member) in the present embodiment, the non-conductive member 85 serving as a first high resistance member is fitted to the projecting portion 82*a*. The non-conductive member 85 serving as a first high resistance member is made of a high-resistance material having a higher electrical resistance than an electrical resistance of the cored bar 82 (which corresponds to a non-conductive material in the present embodiment). Specifically, in the secondary transfer opposite roller 80 (roller member) in the present embodiment, the non-conductive member 85 made of a non-conductive material such as polycarbonate (PC) that has a high voltage resistance is installed on the projecting portion 82*a* as one of leakage stoppers that prevent the generation of leakage starting from the cored bar 82 to which a high voltage is to be applied. In addition, in the present embodiment, the non-conductive member 85 made of a non-conductive material is used in this manner as a member that functions as one of the leakage stoppers. Alternatively, a member that is made of a high-resistance material having a higher electrical resistance than an electrical resistance of the cored bar 82 functions similarly to the non-conductive member 85 according to the height of the electrical resistance.

In addition, as illustrated in FIG. 5, in the secondary transfer opposite roller 80 (roller member) in the present embodiment, the elastic member 87 serving as a second high resistance member is installed. The elastic member 87 serving as a second high resistance member fills a space formed between the non-conductive member 85 (first high resistance member), the elastic layer 83, and the cored bar 82, so as not to expose the projecting portion 82*a*, without causing elastic deformation that increases the outer diameter of the elastic layer 83. The elastic member 87 serving as a second high resistance member is made of a high-resistance material having a higher electrical resistance than an electrical resistance of the cored bar 82. Specifically, the elastic member 87 (second high resistance member) is made of elastic material having a hardness lower than each of a hardness of the elastic layer 83 and a hardness of the non-conductive member 85 (first high resistance member), and is fitted to the projecting portion 82*a* in an elastically deformed state between the non-conductive member 85 and the elastic layer 83. In the present embodiment, a member that is made of a high-resistance material having a higher electrical resistance than an electrical resistance of the elastic layer 83 is used as the elastic member 87 (second high resistance member).

Figure 6:
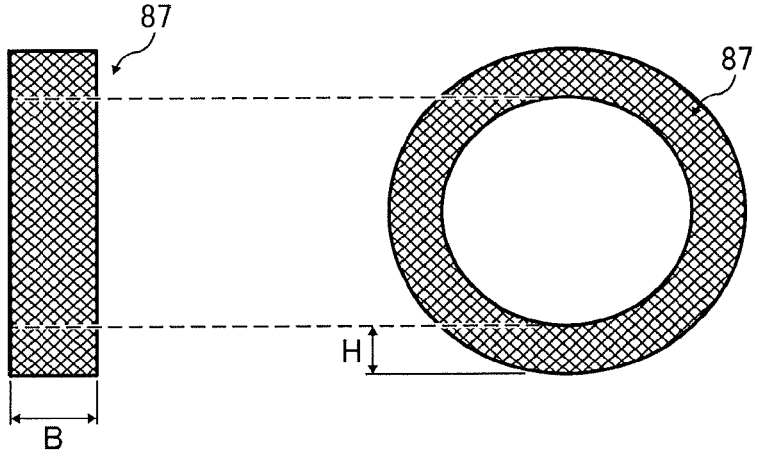
FIG. 6 is an illustration of an elastic member according to an embodiment of the present disclosure.

More specifically, the elastic member 87 in the present embodiment is made of substantially-insulating urethane foam having lower hardness being a hardness (Asker-C hardness) of about 20 degrees, and electrical resistance of about $10^{11}$ to $10^{13}\Omega$, and is formed in a substantially ring shape as illustrated in FIG. 6. Referring to FIG. 6, the elastic member 87 is formed so as to have a width B of about 4 mm in an independent state in which external force is not added thereto. In addition, referring to FIG. 5, the elastic member 87 is lightly pressed onto the cored bar 82 (the projecting portion 82*a*) so as to be sandwiched between the elastic layer 83 and the non-conductive member 85, so that the width B of the elastic member 87 compressed by about 2.5 mm to be a width B' of about 1.5 mm. In other words, because the elastic member 87 is made of low hardness material, the elastic member 87 is installed on the cored bar 82 (the projecting portion 82*a*) so as to fill a clearance between the elastic layer 83 and the non-conductive member 85 by tightly adhering to the elastic layer 83 and the non-conductive member 85, without exerting force to cause deformation, on the elastic layer 83 and the conductive member 85. Furthermore, because the elastic member 87 is made of the high-resistance material, together with the non-conductive member 85, the elastic member 87 functions as a leakage stopper that prevents the generation of leakage starting from the cored bar 82 to which high voltage is to be applied.

In addition, in the present embodiment, a member made of a high-resistance material having a higher electrical resistance than the electrical resistance of the elastic layer 83 is used in this manner as the elastic member 87 that functions as a leakage stopper together with the non-conductive member 85. Alternatively, a member that is made of a high-resistance material having a higher electrical resistance than the electrical resistance of the cored bar 82 similarly functions according to the height of the electrical resistance. In addition, FIG. 5 only illustrates one end side in the axial direction of the secondary transfer opposite roller 80. Nevertheless, as illustrated in FIG. 4, the non-conductive member 85 and the elastic member 87 are similarly installed on the other end side in the axial direction of the secondary transfer opposite roller 80.

By providing the non-conductive member 85 (first high resistance member) and the elastic member 87 (second high resistance member) in this manner, the projecting portion 82*a* of the cored bar 82, which is made of conductive metal material, and to which high voltage is to be applied, is covered by the non-conductive member 85 and the elastic member 87 without any clearances, without directly opposing the intermediate transfer belt 8, the secondary transfer conveyance belt 30, or the cored bar 72 of the secondary transfer roller 70 at a short distance. This reliably reduces such a failure that leakage is generated by the application of high voltage to the secondary transfer opposite roller 80, and a transfer failure or the like occurs.

Figure 7A:
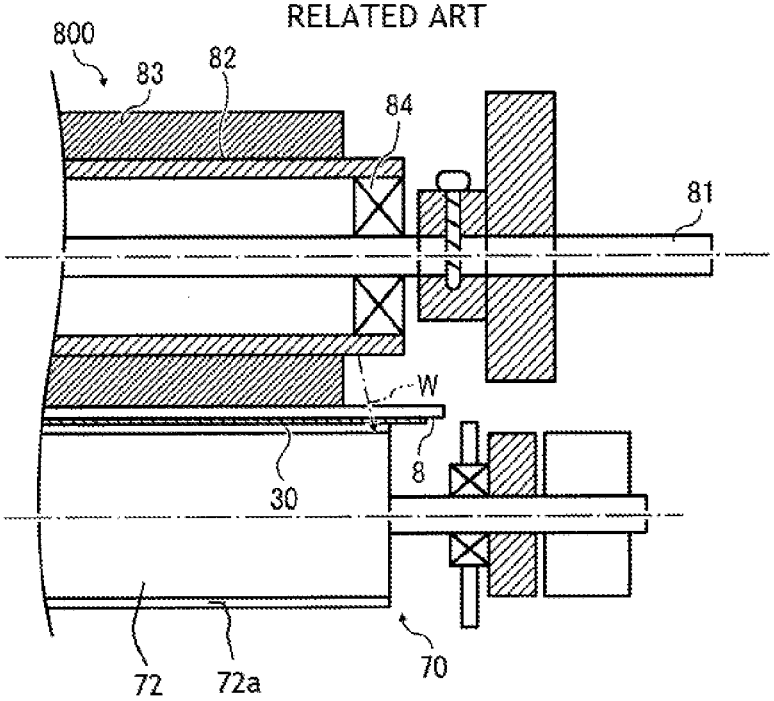
FIG. 7A RELATED ART
FIGS. 7A and 7B are enlarged cross-sectional views illustrating a state in which a secondary transfer opposite roller and a secondary transfer roller contact each other via an intermediate transfer belt and a secondary transfer conveyance belt in a conventional image forming apparatus.
Figure 7B:
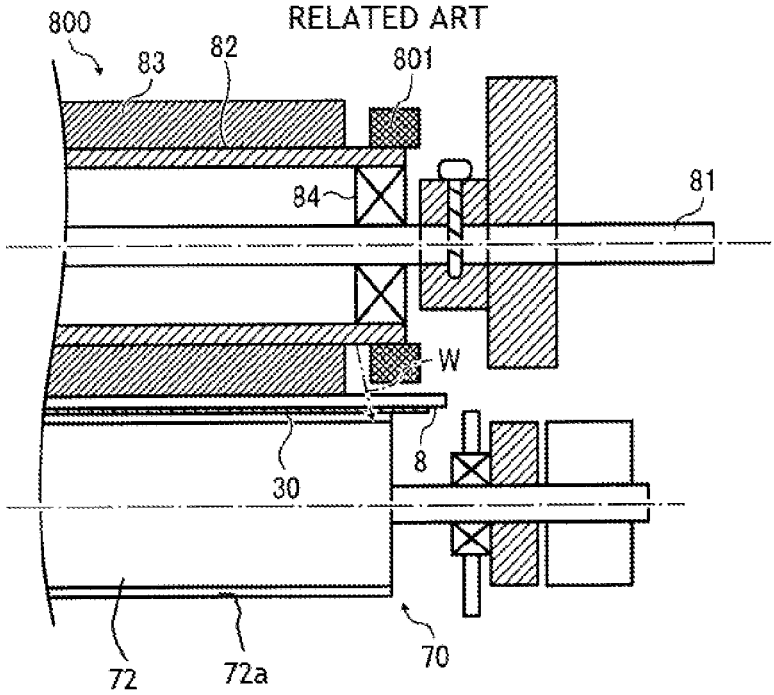
FIG. 7B RELATED ART

More specifically, as illustrated in FIG. 7A, if the non-conductive member 85 and the elastic member 87 is not installed on a secondary transfer opposite roller 800, and a projecting portion of the cored bar 82 is in a bare state, by applying high voltage to the secondary transfer opposite roller 800, leakage W is easily generated by electricity discharged from the projecting portion toward the cored bar 72 while penetrating through the intermediate transfer belt 8, the secondary transfer conveyance belt 30, and the elastic layer 72*a* of the secondary transfer roller 70. In addition, as illustrated in FIG. 7B, even if a support 801 including a collar or a spacer made of a non-conductive material is installed on the secondary transfer opposite roller 800, a clearance is generated between the support 801 and the elastic layer 83, and a part of the projecting portion of the cored bar 82 becomes the bare state, so that the leakage W is easily generated as well. In contrast to this, in the present embodiment, the non-conductive member 85 and the elastic member 87 that have insulation properties (or electrical properties close to this) are installed on the projecting portion 82*a* to fully block the route of the leakage W. Thus, the generation of the above-described leakage W can be prevented.

Furthermore, in the present embodiment, the elastic member 87 is made of low hardness material, and force to cause elastic deformation that increases the outer diameter of the elastic layer 83 is not exerted on the elastic layer 83. This can prevent the occurrence of such a failure that the end of the elastic layer 83 deforms to expand, and a secondary transfer nip uniform in the axial direction fails to be formed, and a transfer failure occurs. In other words, if the non-conductive member 85 is directly pressed against an end face 83*a* of the elastic layer 83 without providing the elastic member 87, the end of the elastic layer 83 expands and the secondary transfer nip becomes ununiform in the axial direction, so that a transfer failure such as transfer unevenness is easily generated in a toner image transferred from the intermediate transfer belt 8 onto the recording medium P. In contrast to this, in the present embodiment, on the projecting portion 82*a* of the cored bar 82 of the secondary transfer opposite roller 80, the non-conductive member 85 (first high resistance member) is installed to contact the elastic layer 83 via the elastic member 87 (second high resistance member) having low hardness. This can prevent such a failure that the end of the elastic layer 83 expands. In addition, this can prevent such a failure that the elastic layer 83 is damaged.

Here, in the present embodiment, the non-conductive member 85 is a cap-shaped member, and is secured on the cored bar 82 to cover an end face 82*b* of the projecting portion 82*a*, and to tightly adhere to the projecting portion 82*a*. In other words, the non-conductive member 85 is fixedly installed on the cored bar 82 to tightly adhere to the projecting portion 82*a*, with the end face 82*b* of the projecting portion 82*a* not being exposed. Specifically, the non-conductive member 85 is a cap-shaped member in which a hole (formed so as not to prevent the movement of the ball of the ball bearing 84, and the relative rotational operation of the shaft 81) is formed on a bottom covering the end face 82*b* of the cored bar 82. In addition, the non-conductive member 85 is lightly pressed onto the cored bar 82 to cover the entire region of the outer circumferential face of the projecting portion 82*a* in a tightly-adhered state, together with the elastic member 87, by contacting a part of the end face 83*a* of the elastic layer 83 via the elastic member 87, and to cover the entire region (is a region corresponding to the thickness of the cored bar 82) of the end face 82*b* of the projecting portion 82*a* in a tightly-adhered state. Here, "the lightly-pressed state" refers to a state in which the non-conductive member 85 is pressed onto the projecting portion 82*a* with a condition set to such a degree that a deformation is not generated in the cored bar 82. It also refers to a state in which the non-conductive member 85 is not shifted in position or separated from the projecting portion 82*a* as long as the secondary transfer opposite roller 80 is used in a normal state without especially-large force being exerted on the non-conductive member 85. In other words, the non-conductive member 85 is installed to be rotatable together with the secondary transfer opposite roller 80, without shifting in position or idling. In this manner, by the non-conductive member 85 covering the end face 82*b* in addition to the outer circumferential face of the projecting portion 82*a*, the route of the leakage W from the end face 82*b* of the projecting portion 82*a* is blocked, so that the generation of the leakage W can be prevented further reliably.

As a procedure for mounting the above-described non-conductive members 85 and the elastic member 87 to the secondary transfer opposite roller 80, after the cutting of the elastic layer 83 that is performed in a state in which the projecting portion 82*a* of the cored bar 82 is chucked has ended as described above, and after the bearings 84 have been completely pressed into the end face 82*b* of the cored bar 82, the elastic member 87 is inserted and installed on the projecting portion 82*a*. After that, the non-conductive member 85 is lightly pressed onto the projecting portion 82*a*. In addition, after the non-conductive members 85 have been completely pressed onto the projecting portion 82*a*, the shaft 81 is inserted into the bearings 84. After that, the cams 91 and 92, and the like are fixedly installed, so that the assembly of the secondary transfer opposite roller 80 is completed.

In the present embodiment, the non-conductive member 85 contacts the end face 82*b* at the axial direction end of the projecting portion 82*a*. Specifically, the position in the axial direction of the non-conductive member 85 is defined (the non-conductive member 85 is positioned) by being installed to contact the end face 82*b* at the axial end of the projecting portion 82*a*. With this configuration, a compression amount (B-B') in the axial direction of the elastic member 87 installed between the elastic layer 83 and the non-conductive member 85 is set with relatively-high accuracy. This further reliably exerts a function of filling a clearance between the elastic layer 83 and the non-conductive member 85 without deforming the elastic layer 83.

Here, the non-conductive member 85 is preferably formed so that a thickness D becomes 1.5 mm or more. This is because, if the thickness D is less than 1.5 mm, even though the non-conductive member 85 completely covers the surface of the projecting portion 82*a*, leakage may be generated to penetrate through the non-conductive member 85. In addition, in the present embodiment, the thickness D of the non-conductive member 85 is set to 1.5 mm.

In a similar manner, referring to FIG. 6 and the like, the elastic member 87 is preferably formed so that a thickness H (corresponding to a difference between the outer diameter and the inner diameter) becomes 1.5 mm or more. This is because, if the thickness H is less than 1.5 mm, even though the elastic member 87 completely covers a part of the surface of the projecting portion 82*a*, leakage may be generated to penetrate through the elastic member 87. In addition, the elastic member 87 is preferably formed so that the thickness H (corresponding to a difference between the outer diameter and the inner diameter) becomes sufficiently smaller than a thickness C of the elastic layer 83. This is because, if the thickness H becomes larger than the thickness C of the elastic layer 83, the elastic member 87 is pressed against the secondary transfer roller 70 via the intermediate transfer belt 8 and the secondary transfer conveyance belt 30, so that a secondary transfer nip may become ununiform in the axial direction. In particular, the elastic member 87 is installed on the cored bar 82 (the projecting portion 82*a*) in a state of being compressed in the axial direction as described above. The elastic member 87 is accordingly elongated in the radial direction by an amount corresponding to the compression. It is therefore necessary to set the thickness H in a state in which there is no external force, to be sufficiently smaller than the thickness C of the elastic layer 83, in prospect of the elongated amount. In addition, in the present embodiment, a layer thickness C of the elastic layer 83 is set to 5 mm, and the thickness H of the elastic member 87 is set to about 3 mm.

Figure 8:
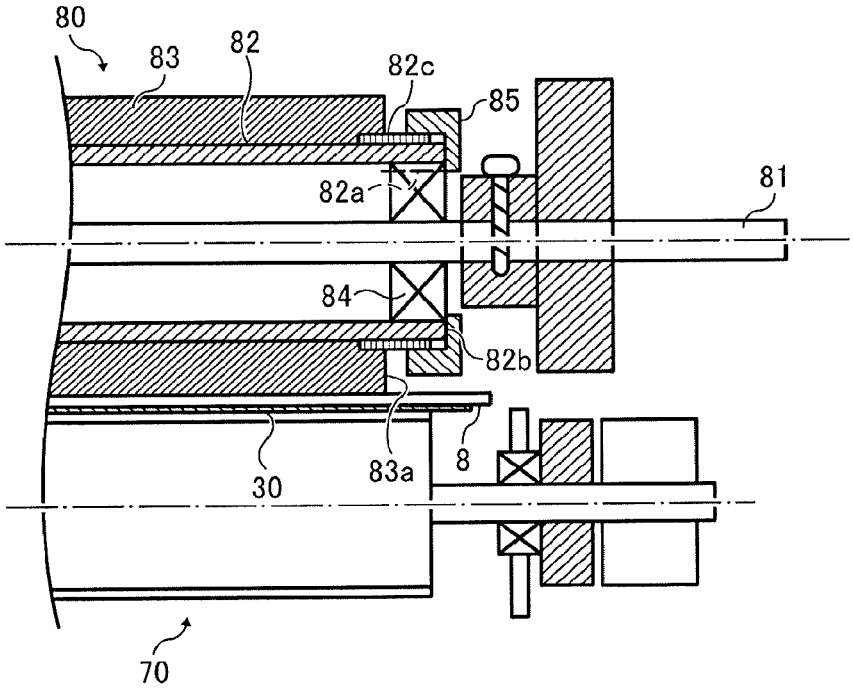
FIG. 8 is a cross-sectional view illustrating an axial end in a state in which a secondary transfer opposite roller and a secondary transfer roller contact each other via an intermediate transfer belt and a secondary transfer conveyance belt, serving as Variation 1, in an enlarged manner.

Here, FIG. 8 is an enlarged view illustrating an axial end of the secondary transfer opposite roller 80 (roller member) and a vicinity thereof, serving as Variation 1. In the present embodiment, as illustrated in FIG. 5, the elastic member 87 serving as a second high resistance member that fills a space formed between the non-conductive member 85, the elastic layer 83, and the cored bar 82, so as not to expose the projecting portion 82*a*, without causing elastic deformation that increases the outer diameter of the elastic layer 83 is used. In contrast to this, in Variation 1 illustrated in FIG. 8, a coating layer 82*c* is used as a second high resistance member that fills a space formed between the non-conductive member 85, the elastic layer 83, and the cored bar 82, so as not to expose the projecting portion 82*a*, without causing elastic deformation that increases the outer diameter of the elastic layer 83. The coating layer 82*c* coats an area of the outer circumferential face of the cored bar 82 including the projecting portion 82*a*, so as to enter an axial center side from the end face 83*a* of the axial end of the elastic layer 83. As an example of the coating layer 82*c* that functions as a second high resistance member in this manner, resin material having insulation properties, and having a thickness of about several tens μm to 2 mm can be used. Specifically, in the step of stacking the elastic layer 83 on the cored bar 82, first, the coating layer 82*c* is formed on a part (corresponds to a position illustrated in FIG. 8) of the cored bar 82, the elastic layer 83 is subsequently pressed onto the cored bar 82 on which the coating layer 82*c* is partially formed, and cutting is next performed in a state in which both axial ends of the cored bar 82 are chucked, to uniformize the outer diameter of the elastic layer 83.

Then, as illustrated in FIG. 8, the non-conductive member 85 (first high resistance member) is fitted to the projecting portion 82*a* to contact the coating layer 82*c* with a clearance between the non-conductive member 85 and the elastic layer 83. Even with such a configuration, the projecting portion 82*a* of the cored bar 82 to which high voltage is to be applied is covered by the non-conductive member 85 and the coating layer 82*c* without any clearances. This reliably reduces such a failure that leakage is generated by the application of a high voltage to the secondary transfer opposite roller 80, and a transfer failure or the like occurs. Furthermore, by using the above-described manufacturing method, the coating layer 82*c* does not exert force to cause elastic deformation that increases the outer diameter of the elastic layer 83, on the elastic layer 83. This can also prevent the occurrence of such a failure that the end of the elastic layer 83 deforms to expand, and a secondary transfer nip uniform in the axial direction fails to be formed, and a transfer failure occurs. In addition, this can prevent such a failure that the elastic layer 83 is damaged. In addition, in the example illustrated in FIG. 8, the coating layer 82*c* is formed on a part (corresponds to a side close to the elastic layer 83) of the projecting portion 82*a* so that the coating layer 82*c* contacts the non-conductive member 85. Alternatively, the coating layer 82*c* can be formed on the entire projecting portion 82*a*. Nevertheless, it is preferable that a range of the coating layer 82*c* formed so as to enter the axial center side from the end face 83*a* of the axial end of the elastic layer 83 falls outside an image area, considering the influence on electrical resistance of the surface of the elastic layer 83.

Figure 9:
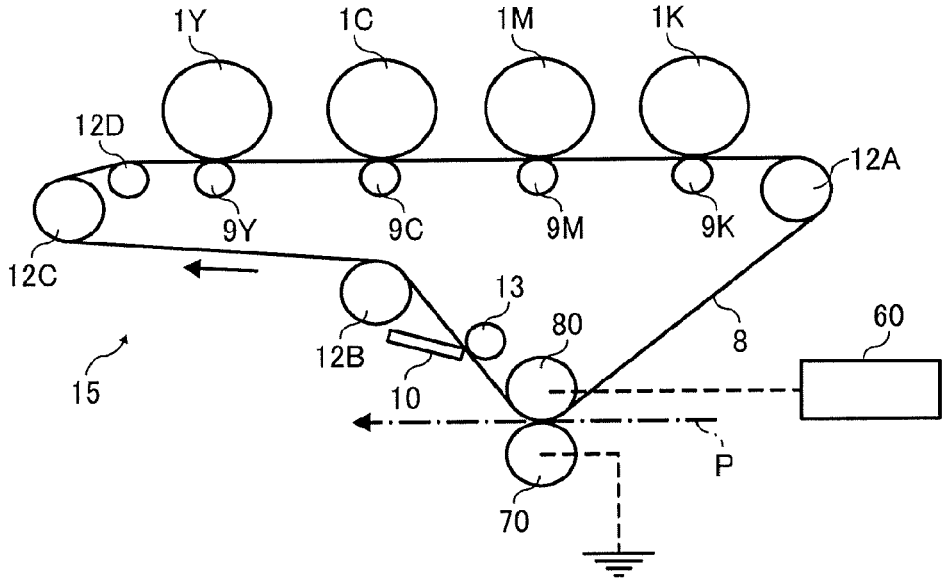
FIG. 9 is a schematic view illustrating an intermediate transfer belt and a vicinity thereof, serving as Variation 2.

In addition, FIG. 9 is a diagram illustrating a main part of an image forming apparatus, serving as Variation 2. Unlike the image forming apparatus in the present embodiment that is illustrated in FIG. 3, in the image forming apparatus in Variation 2 that is illustrated in FIG. 9, the secondary transfer conveyance belt 30 is not installed, and the secondary transfer roller 70 is formed to directly contact the intermediate transfer belt 8 to form a secondary transfer nip. In other words, the secondary transfer opposite roller 80

(roller member) contacts (opposes) the secondary transfer roller 70 via the intermediate transfer belt 8 at the secondary transfer nip. Even with such a configuration, by providing the non-conductive member 85 (first high resistance member) and the elastic member 87 (second high resistance member) on the secondary transfer opposite roller 80 (roller member) similarly to that in the present embodiment (or Variation 1), an effect similar to that in the present embodiment can be obtained.

As described above, in the present embodiment, in the secondary transfer opposite roller 80 (roller member), the cored bar 82 with the elastic layer 83 formed on its outer circumferential face has the projecting portion 82*a* formed to project from the range in which the elastic layer 83 is formed, toward the axial end. In addition, the non-conductive member 85 (first high resistance member) is fitted to the projecting portion 82*a*, and the elastic member 87 (second high resistance member) that fills a space formed between the non-conductive member 85 and the elastic layer 83 is installed. This can make it difficult to generate leakage, and can prevent damages, even if high voltage is applied to the secondary transfer opposite roller 80.

In addition, in the present embodiment, the secondary transfer step is performed by applying the secondary transfer bias (is voltage having the negative polarity) only to the secondary transfer opposite roller 80 of the secondary transfer roller 70 and the secondary transfer opposite roller 80 that contact each other via the intermediate transfer belt 8 (and the secondary transfer conveyance belt 30) to form the secondary transfer nip to which the recording medium P is conveyed. In contrast to this, the secondary transfer step can be performed by directly or indirectly applying the secondary transfer bias (is voltage having a positive polarity) only to the secondary transfer roller 70 serving as a roller member. Alternatively, the secondary transfer step can be performed by directly or indirectly applying the secondary transfer bias to both of the secondary transfer roller 70 and the secondary transfer opposite roller 80. Even in such a case, by applying the present disclosure to a roller member to which the secondary transfer bias is to be applied, an effect similar to that in the present embodiment can be obtained. In addition, in the present embodiment, by applying the present disclosure also to a roller member to which the secondary transfer bias is not to be applied (is the secondary transfer roller 70 in the present embodiment), a leakage route from the secondary transfer opposite roller 80 to which the secondary transfer bias is to be applied can be blocked on the side of the opposing secondary transfer roller 70. This can reduce the generation of leakage.

In addition, in the present embodiment, the present disclosure is applied to the secondary transfer opposite roller 80 in which the cored bar 82 is formed into a cylindrical shape (hollow shape). Nevertheless, the present disclosure can also be applied to a secondary transfer opposite roller in which a cored bar is formed into a columnar shape (solid shape). In addition, even in such a case, an effect similar to that in the present embodiment can be obtained.

In addition, in the present embodiment, as illustrated in FIG. 5 and the like, the non-conductive member 85 is installed to contact the end face 82*b* at the axial end of the projecting portion 82*a* throughout the whole circumference (to cover the entire end face 82*b*). Nevertheless, the shape of the non-conductive member 85 is not limited to this. For example, the non-conductive member 85 may be formed to contact only a part of the whole circumference of the end face 82*b* at the axial end of the projecting portion 82*a*. In other words, only a part of the end face 82*b* of the projecting portion 82*a* may be covered, and the remaining portion may be exposed. In addition, in the present embodiment, the non-conductive member 85 is positioned by contacting the cored bar 82. Alternatively, the non-conductive member 85 may be positioned with respect to a member other than the cored bar 82. For example, the non-conductive member 85 may be positioned with respect to the bearing 84, the cam 91, or the like. In addition, the non-conductive member 85 may be installed to cover the end face 82*b* at the axial end of the projecting portion 82*a*, and an end face at an axial end of the bearing 84. In addition, even in such cases, an effect similar to that in the present embodiment can be obtained.

In addition, in the present embodiment, in the color image forming apparatus 1000, the present disclosure is applied to the secondary transfer opposite roller 80 that forms a secondary transfer nip by contacting the secondary transfer roller 70 via the intermediate transfer belt 8 (and the secondary transfer conveyance belt 30) serving as an image bearer. In contrast to this, in a monochromatic image forming apparatus, the present disclosure can be applied also to a transfer roller serving as a roller member that forms a transfer nip by contacting a photoconductor drum serving as an image bearer. In addition, the application target of the present disclosure is not limited to the secondary transfer opposite roller 80. The present disclosure can be applied to all roller members as long as the roller members are roller members in which elastic layers are formed on cored bars, projecting portions are formed, and leakage can be generated. In addition, even in such a case, an effect similar to that in the present embodiment can be obtained.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims. In addition, the number, the position, the shape, and the like of the components are not limited to those in the present embodiment. The number, the position, the shape, and the like that are preferable for practicing the present disclosure can be employed.

What is claimed is:

1. A roller member comprising:

a cored bar;

an elastic layer disposed on an outer circumferential face of the cored bar, the cored bar having a projecting portion projecting beyond a range in which the elastic layer is disposed, toward an axial end of the cored bar;

a first high resistance member made of a high-resistance material having a higher electrical resistance than an electrical resistance of the cored bar, the first high resistance member fitted to the projecting portion; and a second high resistance member made of a high-resistance material having a higher electrical resistance than an electrical resistance of the cored bar, the second high resistance member filling a space between the first high resistance member and the elastic layer.

2. The roller member according to claim 1, wherein the second high resistance member is made of an elastic material having a hardness lower than each of a hardness of the elastic layer and a hardness of the first high resistance member, and wherein the second high resistance member is fitted to the projecting portion in an elastically deformed state between the first high resistance member and the elastic layer.

3. The roller member according to claim 1, wherein the second high resistance member is a coating layer to coat an area of the outer circumferential face of the cored bar, the area including the projecting portion and a portion entering from an end face of an axial end of the elastic layer toward an axial center of the elastic layer, and wherein the first high resistance member is fitted to the projecting portion to contact the coating layer with a clearance between the first high resistance member and the elastic layer.

4. The roller member according to claim 1, wherein the high resistance material of the second high resistance member has a higher electrical resistance than an electrical resistance of the elastic layer.

5. The roller member according to claim 1, wherein the first high resistance member is a non-conductive member made of a non-conductive material, and wherein the first high resistance member is disposed to contact an end face of an axial end of the projecting portion.

6. An image forming apparatus comprising:

an image bearer to bear a toner image;

a transfer roller contacting the image bearer directly or via a belt member to form a transfer nip;

the roller member according to claim 1 disposed opposing the transfer roller at the transfer nip; and a power source to output a transfer bias to transfer the toner image from the image bearer onto a recording medium at the transfer nip, the power source to directly or indirectly apply the transfer bias to the cored bar.

7. The image forming apparatus according to claim 6, wherein an axial range of the elastic layer in the roller member is included in an axial range of a roller portion in the transfer roller.

8. The image forming apparatus according to claim 6, further comprising:

a photoconductor having a surface on which a toner image is to be formed, wherein the image bearer is an intermediate transfer belt onto which the toner image on the photoconductor is to be transferred, and wherein the belt member is a secondary transfer conveyance belt to travel along a conveyance direction of the recording medium.

9. An image forming apparatus comprising:

an image bearer to bear a toner image;

the roller member according to claim 1 contacting the image bearer directly or via a belt member to form a transfer nip; and a power source to output a transfer bias to transfer the toner image from the image bearer onto a recording medium at the transfer nip, the power source to directly or indirectly apply the transfer bias to the cored bar.

10. The image forming apparatus according to claim 9, further comprising:

a photoconductor having a surface on which a toner image is to be formed, wherein the image bearer is an intermediate transfer belt onto which the toner image on the photoconductor is to be transferred, and wherein the belt member is a secondary transfer conveyance belt to travel along a conveyance direction of the recording medium.

* * * * *